US005103514A

United States Patent [19]

Leach

[11] Patent Number: 5,103,514

[45] Date of Patent: Apr. 14, 1992

[54] UTILITY PAD FOR INFANTS AND TODDLERS

[76] Inventor: Jamie S. Leach, 1325 Whispering Hills, Ada, Okla. 74820

[21] Appl. No.: 800,287

[22] Filed: Nov. 29, 1991

[51] Int. Cl.[5] ..... A47C 21/08; A47C 20/00; A47C 27/00

[52] U.S. Cl. ..... 5/417; 5/420; 5/424; 5/427; 5/465; 5/922

[58] Field of Search ..... 5/417, 420, 424, 431, 5/436, 437, 465, 427, 99.1

[56] References Cited

U.S. PATENT DOCUMENTS

| | | | |
|---|---|---|---|
| 1,577,586 | 3/1926 | Morehouse | 5/417 |
| 2,626,407 | 1/1953 | Kurry | 5/465 X |
| 4,709,430 | 12/1987 | Nicoll | 5/417 |
| 4,754,509 | 7/1988 | Pollard | 5/425 |
| 4,788,726 | 12/1988 | Rafalko | 5/424 X |
| 4,999,866 | 3/1991 | Lindsey | 5/417 |
| 5,035,013 | 7/1991 | Bloom | 5/420 |

*Primary Examiner*—Michael F. Trettel
*Attorney, Agent, or Firm*—Laney, Dougherty, Hessin & Beavers

[57] ABSTRACT

A utility pad for infants and toddlers which includes a flexible, rectangular fabric tube filled with a resilient, flexible material and extending peripherally around an interior space. The tube carries a plurality of cooperating engaging elements on one side thereof positioned so that the tube can be folded double into a U-shape and there retained by registering, interengaging ones of said engaging elements disposed at the superimposed opposite ends of the tube doubled into a U-shape. Carrying straps extend outwardly from opposite sides of the tube. A flat sheet is detachably secured across the bottom of the tube to close the space surrounded by the tube and form a sleeping surface for an infant.

13 Claims, 2 Drawing Sheets

UTILITY PAD FOR INFANTS AND TODDLERS

FIELD OF THE INVENTION

This invention relates to a versatile, multi-utility pad for use in a variety of quickly manually developed configurations by sleeping, sitting and playing infants.

BACKGROUND OF THE INVENTION

Brief Description of the Prior Art

Infants and toddlers of imperfect motor skills must generally be placed in a controlled and protected environment for sleeping and playing in order to both enhance their comfort, and in some cases, restrict their mobility, and protect them from frightening, and sometimes injurious, falls. Laterally enclosed cribs are widely used to accommodate the sleeping infant, and various types of pads have been available to line the crib to prevent the infant from rolling into the slats or bars of the crib, or from falling, being bruised or at least frightened. These pads are often long strips of quilted or padded material which are hung or attached to the sides of the crib after being wrapped around the inner sides of the crib walls.

A waterproof sheet or pad is also often laid over the mattress in the crib to prevent soiling of the mattress by the infant, or contact of the infant with the not totally sanitary surface of the mattress.

Playpens, too, like cribs, require protective and cushioning padding on both the floor and around the sides of the playpen.

Where no playpen or crib is available, as is sometimes the case upon traveling and visiting away from home, the infant is sometimes just put down for a nap upon a sheet placed upon a carpet, and little effort is made to prevent the infant from rolling off of the sheet and on to the carpet. Greater danger to the infant is entailed in simply laying the infant on a made-up adult bed, and in such case, a somewhat continuous surveillance of the sleeping baby is required.

BRIEF DESCRIPTION OF THE PRESENT INVENTION

The present invention is a relatively inexpensive, highly versatile and utilitarian safety and sleeping pad for infants and toddlers. It can be quickly converted to any of several geometrically different forms for use in different ways, and it can be folded into a compact shape, and this, coupled with its very light weight, permits it to be easily hand carried from one place of use to another.

Broadly described, the utility pad of the invention includes a rectangular fabric tube which has a round or elliptical or oval cross-sectional configuration. The tube is filled with a soft resilient material, such as foam rubber or polyester filler material, and the tube preferably has a height or thickness such that small infants cannot roll or crawl over the tube, but are instead confined within the space inside the rectangular tube.

The tube defines an enclosure when it is in its flat, folded out form. It has two opposite, substantially parallel end portions, each of which carries a plurality of mutually interengageable Velcro® tabs. This enables the tube to be folded double into a U-shaped configuration with one end portion superimposed upon the other and there retained by the adherent engagement of the Velcro® tabs. The tube also has a pair of opposed, substantially parallel lateral sides which extend between, and interconnect, the two opposed end portions. These lateral sides also have Velcro® tabs located thereon and facing from the utility pad in the same direction as the tabs carried on the end portions.

The utility pad also includes a base sheet which is adapted to be quickly and manually engaged with, or detached from, the rectangular tube along one side thereof so as to form a ground cloth or a protected bed sheet extending across, and closing, the bottom of the interior opening within the rectangular tube. Instead of a thin, flat optionally waterproof sheet, a flat, soft body pad adapted to gently support the infant may be used at the same location.

Midway of each of the opposite lateral sides of the tube, a pair of securing and carrying straps extend outwardly from the sides and each of these straps carries an engaging element or fastener to permit the two straps to be interengaged to form handles, thereby facilitating carrying of the utility pad, and also functioning in one geometric status of the pad to retain it in a certain generally triangular shape for certain usages.

An important object of the present invention is to provide a utility pad for infants and toddlers which can be selectively geometrically folded so that it can be used in a number of ways and have various functions in the care of infants and toddlers.

A more specific object of the invention is to provide a utility pad which can be used as a comfortable bed in the home or during travel, in the crib or in the playpen or upon the floor or upon an adult bed, and in all such usages provides a comfortable, safe area of repose for a sleeping infant.

A further object of the invention is to provide a utility pad for infants and toddlers which carries a soft peripheral tube acting as a barrier to infants or toddlers located within such peripheral barrier, and preventing them from rolling or crawling to the outside of the pad, and which facilitates securement of a sheet or soft pallet which can be quickly and easily attached to one side of the tubular barrier, and can be just as quickly and easily detached when the utility pad is to be folded into a different configuration, or when it is desired to launder the detachable sheet.

Another object of the invention is to provide a utility pad for infants and toddlers which can be quickly and easily interconverted between a bed configuration and a head nuzzler which can be placed at the head of the crib or playpen to protect the infant's head from the crib rails and hard corners. At the same time, the pad provides some constraint upon the lateral movement of the infant to limit its rolling movement on the floor of the playpen or the mattress of the crib.

A further object of the invention is to provide a utility pad for infants and toddlers which can be made up into a shape which acts as a sturdy support to help the infant sit upright, and which can be folded into a confining triangular shape to more restrictively confine the baby to the interior thereof.

Another object of the invention is to provide a utility pad for infants and toddlers which can be used as a confining bed or as a replacement for bumper pads in cribs, porta-cribs and playpens.

Another object of the invention is to provide a utility pad for infants and toddlers which can be folded into a compact, transport form, and which then provides a readily accessible and easily used handle for carrying the pad when it is folded into such transport status.

Another important object of the invention is to provide a utility pad for infants and toddlers which can be used as a replacement for several different types of products used for infant care at the present time, none of which products are interchangeable with the other, so that the present invention obviates the need to buy and maintain several different products.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
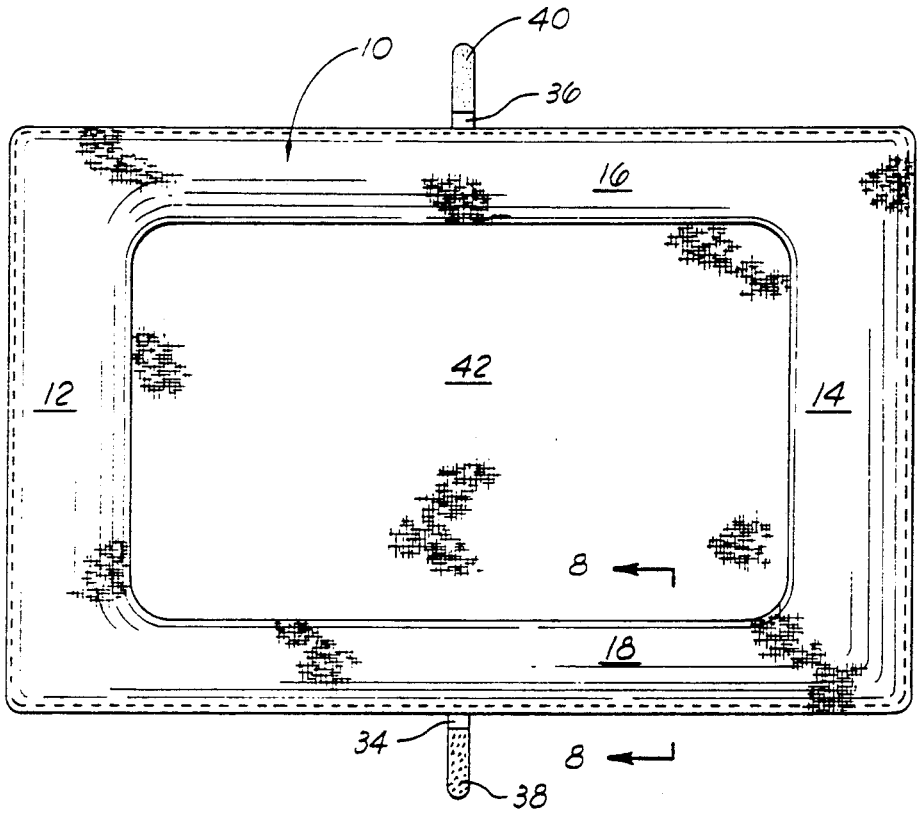
FIG. 1 is a top plan view of the utility pad for infants and toddlers constructed in accordance with the present invention.
Figure 8:
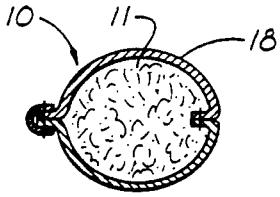
FIG. 8 is a sectional view taken along line 8—8 of FIG. 1.

Referring initially to FIG. 1 and FIG. 8 of the drawings, the utility pad of the invention, in the illustrated embodiment, includes a rectangular fabric tube 10. One cross-sectional configuration which may characterize the tube is shown in FIG. 8 of the drawings, and is slightly oval. The tube may, however, be circular or elliptical in cross-section. The rectangular fabric tube 10 is, as illustrated in FIG. 8, filled with a soft, resilient, washable material 11, such as foam rubber, polyester particles or the like.

In the illustrated embodiment of the invention, the tube 10 is formed from two parts or panels of the fabric material which are sewn together at the edges in the manner illustrated in FIG. 8. Other forms of construction can be used, however, but the general requirements which must characterize all such forms are that the tube be substantially rectangular in configuration, and have a hollow interior which is filled with a flexible resilient material as hereinafter described. The tube 10 can be made from various materials but must be flexible and sufficiently strong to retain the filler material 11 on the inside thereof over an extended service life.

As shown in FIG. 1, the rectangular fabric tube 10 in the illustrated configuration forms a peripheral barrier at the outer perimeter of a play or sleeping zone within the tube. In other types of usage, the rectangular tube will be folded into different configurations. The rectangular fabric tube 10 has a pair of opposed, substantially parallel end portions 12 and 14, and a pair of opposed, substantially parallel lateral sides 16 and 18.

Figure 2:
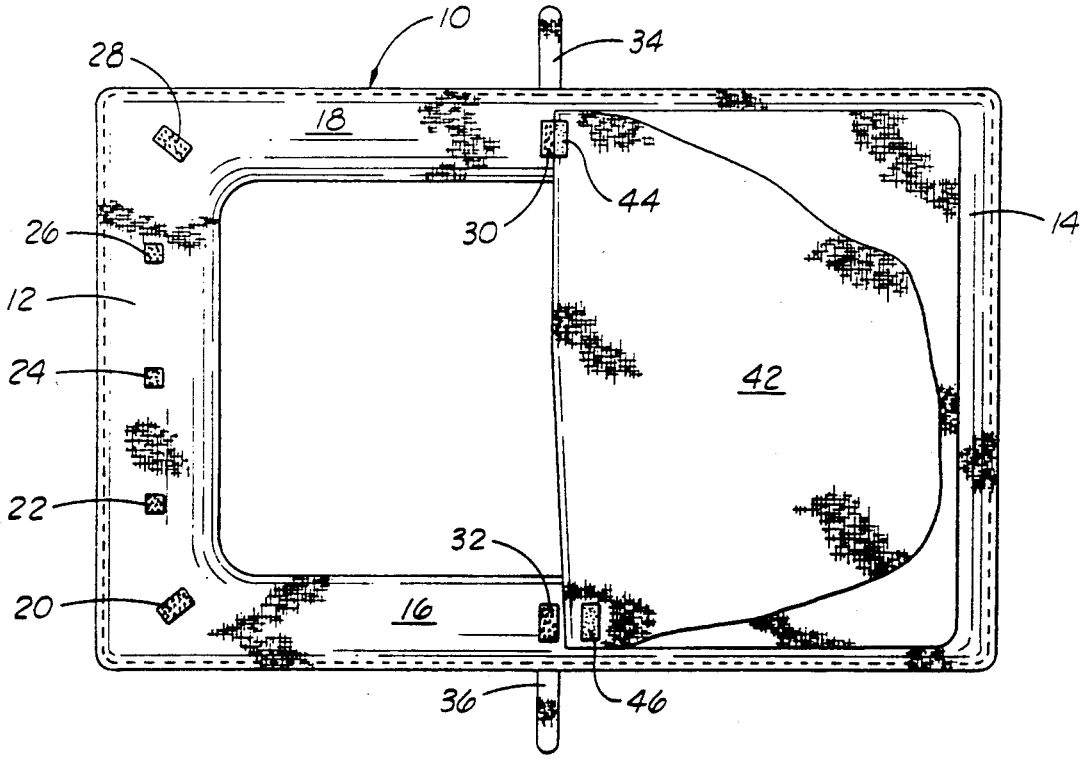
FIG. 2 is a bottom plan view of the utility pad depicted in FIG. 1, but showing a portion of the bottom detachable support sheet folded back and broken away for purposes of better illustrating the construction of the utility pad.

As FIGS. 1 and 2 are considered together, it will be perceived that the rectangular fabric tube 10 includes an upper side and a lower side or bottom with the upper side being shown in FIG. 1. The bottom or lower side is shown in FIG. 2 and is adapted to be rested upon a substantially flat supporting surface as shown in FIG. 1.

On the underside or bottom of each of the parallel end portions 12 and 14, a plurality of fastener or engaging elements are secured in spaced relation to each other from one corner of the rectangular fabric tube 10 to the other. In a preferred embodiment of the invention, these fastener or engaging elements are Velcro® tabs, and are hook and loop fasteners denominated in FIG. 2 by reference numerals 20–28 as they appear at one end of the utility pad. The manner in which the Velcro® tabs function is well understood in the art. Additional engaging elements, which are also preferably Velcro® tabs, are secured to the underside of the end portion 14. These latter tabs are positioned in correspondence to the tabs 20–28 so that at a time when the utility pad is folded into a configuration of one of the types shown in FIGS. 3 and 5, one of the end portions 12 can be superimposed upon, and adhered to or engaged with, the other end portion 14 as the engaging elements or tabs carried on each of the end portions come into contact and effect engagement.

In addition to the Velcro® tabs which are preferably used as the fastening or engagement tabs or elements at each of the opposite end portions 12 and 14 of the rectangular fabric tube 10, there is also at least one of the Velcro® tabs or fasteners carried at substantially the midpoint along the lower surface of each of the parallel lateral sides 16 and 18. These two Velcro® tabs are shown in FIG. 2 and are there denominated by reference numerals 30 and 32.

Secured to each of the parallel lateral sides 16 and 18 about midway between the upper surface and the lower surface thereof, and projecting outwardly from such lateral sides, are a pair of securing and carrying straps 34 and 36. The securing and carrying straps 34 and 36 are elongated flexible strap elements which have secured thereto, fastening devices, such as cooperating Velcro® patches or tabs. These patches are denominated by reference numerals 38 and 40, respectively. The purpose of the elongated flexible securing and carrying straps 34 and 36 will be hereinafter explained and discussed.

One of the main functions of the several Velcro® tabs 20–28, 30 and 32, and those corresponding Velcro® tabs located on the underside of the end portion 14, is to provide points of anchoring or securement for a sheet or ground cloth or pallet which is to be secured to the underside of the tube 10. A sheet 42 of this type is shown in top plan view in FIG. 1 as it appears when secured in position to the underside of the rectangular fabric tube 10. The sheet 42 is shown being detached, and is in a partially folded back position in FIG. 2. Thus, in FIG. 2 the end portion of the sheet 42 has been broken away at that location where such sheet would carry Velcro® tabs corresponding to and registering with the Velcro® tabs 20–28 and functioning to permit one end portion of the sheet to be securely attached to the lower side of one end portion 12 of the rectangular fabric tube 10.

As will be apparent as reference is made to FIG. 2, the bottom sheet 42 also carries Velcro® tabs 44 and 46 adjacent the center line thereof in a position such that they can contact and engage the Velcro® tabs 30 and 32 carried on the tube 10. It will be helpful in referring to FIG. 2, to understand that in one operative position of the utility pad, such as the position shown in FIG. 3, the sheet 42 is doubled back into essentially the same position as is shown in FIG. 2, and then the end of the rectangular fabric tube 10 which is there shown in the exposed status is doubled back into a superimposed position atop the right half of the rectangular tube 10, with the doubled or folded sheet 42 between the folded half portions of the rectangular tube.

Referring further to FIG. 2, it will sometimes be desirable to completely remove the sheet 42 and simply allow the rectangular open fabric tube 10 to function as a bumper pad, such as around the periphery of a crib or playpen, with the bottom open to the mattress or the floor (as the case may be).

Figure 3:
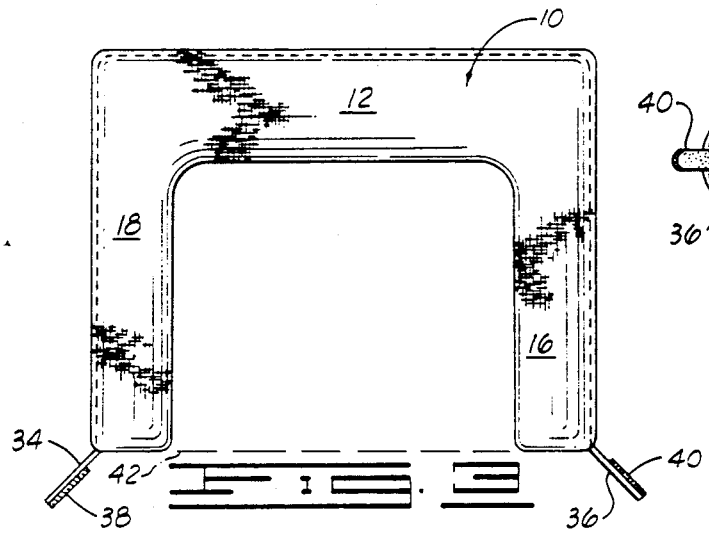
FIG. 3 is a top plan view of the utility pad of the invention after it has been folded into a form which provides several useful functions in the care and nurturing of infants. The dashed line shown in FIG. 3 illustrates the doubled over edge of the bottom or support sheet when it is left attached in place on the underside of the rectangular fabric tube forming a part of the invention.
Figure 4:
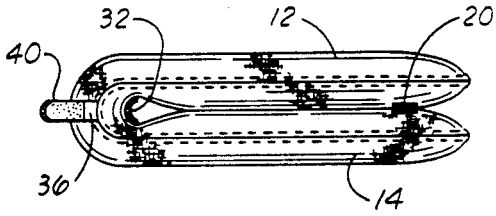
FIG. 4 is a side elevation view of the utility pad as it appears from the side when it is folded into the configuration shown in FIG. 3.

FIGS. 3 and 4 illustrate an alternate mode of usage of the utility pad in which it has been folded in half and simply used as a comfortable head nuzzler. In the full line depiction, the sheet 42 has been removed, and the uniquely placed Velcro® tabs allow the doubled rectangular fabric tube 10 to be locked in this configuration automatically—that is, the Velcro® tabs automatically engage each other when the upper half of the rectangular tube touches the bottom half. The thus configured utility pad can be placed at the head of the crib or playpen to protect the infant's head from the crib rails and hard corners. It also can be used as a restrainer when folded in this position and placed in a crib or playpen to restrain a small infant in approximately the position in which they are placed down for sleep, and thus prevent them from rolling or scooting into a corner of the crib in which they are cramped up and confined.

Figure 5:
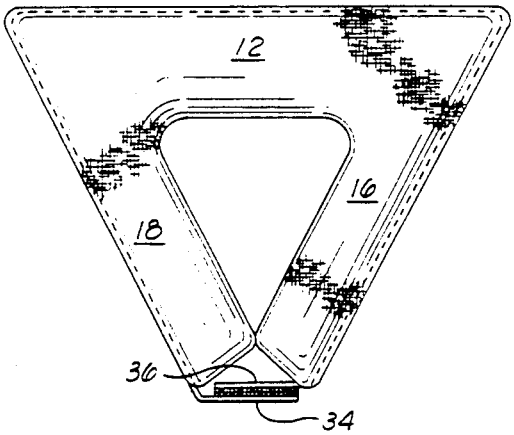
FIG. 5 is a top plan view of the utility pad of the invention after it has been folded into yet another configuration to be used for another purpose, and showing how the utility pad is retained in this configuration by the use of a pair of straps carried thereon, and each having an engaging element mounted at its end.
Figure 6:
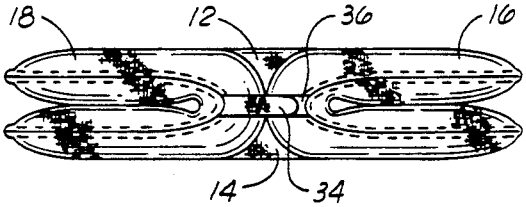
FIG. 6 is an end elevation view showing the utility pad folded as shown in FIG. 5.

FIGS. 5 and 6 of the drawings depict yet another configuration into which the utility pad of the invention can be folded. In this position, the utility pad functions as a sturdy encircling support to help the infant sit upright and not fall to one side or the other. As illustrated, the pad is folded into half and the infant is placed sitting upright in the center of the pad. It is then wrapped into the triangular configuration depicted in FIG. 5, with the convergent ends in front of the infant.

The support and carrying straps 34 and 36 can then be attached to each other by means of the Velcro® tabs 38 and 40 which they carry so as to secure the utility pad in this configuration. There is some adjustability in the overall length of the interconnected straps, and this will permit the parent to form the utility pad so as to get the degree of support for the child which is desired. The manner in which the straps 34 and 36 are overlapped to secure the pad in the illustrated configuration is shown in the end view appearing in FIG. 6.

The form of the utility pad shown in FIG. 3 can also be the form which it assumes when the sheet 42 is left in position and the utility pad is folded double as shown in FIGS. 3 and 4. The sheet then has a doubled over edge at the location of the dashed line in FIG. 3. When this configuration of the utility pad is employed, it becomes a half moon-type head protector with a dribble pad located under the sleeping infant's head. This dribble pad can be an absorbent material, or simply a protective fabric to protect the surface underneath the utility pad.

In yet another modified form of the utility pad of the invention, infant play toys can be attached to the inner sides of the pad when it is folded into one of the described configurations. This is accomplished, in one embodiment, by the use of quick connect, easily detachable fasteners, such as Velcro® tabs placed on such inner sides, and Velcro® loops attached to the toys.

Figure 7:
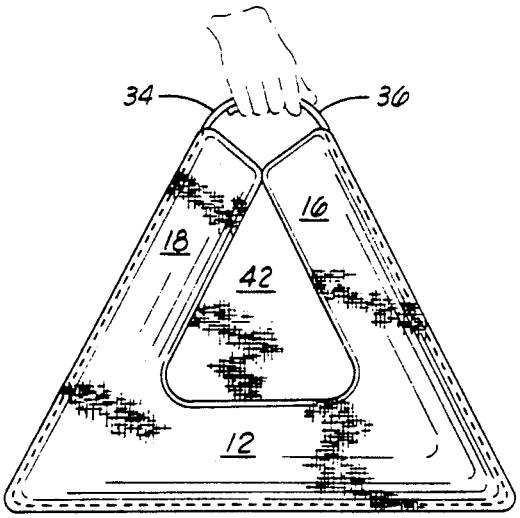
FIG. 7 depicts the utility pad of the invention when it has been folded into a transport status, and is being carried by means of the interconnected straps carried on opposite sides of the utility pad.

When the utility pad is not in use to confine an infant, it can be folded into the position shown in FIGS. 5 and 6, and the overlapped straps 34 and 36 then used as a carrying handle as shown in FIG. 7. It is also possible to conveniently and easily leave the sheet 42 attached to the tube 10 at this time since it will collapse into the space between the folded legs of the rectangular fabric tube 10.

Although a preferred embodiment of the invention has been herein described in order to permit those skilled in the art to understand and practice the invention and to use the principles it embodies, it will be readily recognized that some changes can be effected in the materials of construction and the geometry of the several interconnected elements without departure from the basic principles which make the utility pad such a versatile and widely useful structure for confining, sleeping, raising and amusing infants and toddlers. To the extent therefor that the basic principles herein enunciated continue to appear in, and be relied upon in, the construction of other forms and embodiments of the invention, such forms and embodiments are deemed to be circumscribed by the spirit and scope of the invention, except as they may be necessarily excluded from the scope of the appended claims even when the same are given a reasonably expansive interpretation.

What is claimed is:

1. A utility pad for infants and toddlers comprising:

a flexible, rectangular tube defining a rectangular interior space, said tube having an encircling cross-sectional configuration, and said tube having opposed, substantially parallel end portions and having spaced, parallel lateral sides, and said tube having an upper surface and a lower surface;

a flexible, resilient material filling the hollow interior of the rectangular tube;

fastener elements carried on the lower surface of said tube, and arrayed to provide fastener elements on the lower surface of said end portions so that when said tube is doubled into a U-shaped configuration, with said end portions superimposed on each other, at least a portion of said fastener elements on each of the lower surfaces of said end portions engage each other and retain said tube in a folded, U-shaped configuration;

a rectangular sheet dimensioned to fit across said rectangular tube and close the rectangular interior space defined therewithin and form a bottom when the rectangular tube is opened out to its rectangular configuration; and additional fastener elements carried on said sheet and positioned to engage at least a portion of said first-mentioned fastener elements carried on the lower surface of said end portions to detachably retain said sheet across said rectangular tube positioned to close said rectangular interior space defined therwithin.

2. A utility pad as defined in claim 1 and further characterized as including a pair of flexible fastener and carrier straps extending outwardly from the mid-portion of said parallel, spaced opposite lateral sides and adapted for interengagement with each other when said rectangular tube is folded into a selected position.

3. A utility pad for infants and young children as defined in claim 2 wherein the length of said flexible fastener and carrier straps is such that the folded double tube is pulled into a triangular shape when said straps are engaged with each other.

4. A utility pad for infants and young children as defined in claim 2 wherein said tube is made of a flexible fabric.

5. A utility pad for infants and young children as defined in claim 4 wherein each of said fastener elements is a hook and loop fastener tab.

6. A utility pad for infants and young children as defined in claim 1 wherein said tube is further characterized in having a round or slightly elliptical cross-section.

7. A utility pad for infants and young children as defined in claim 1 wherein said tube is made of a flexible fabric.

8. A utility pad for infants and young children as defined in claim 1 wherein said sheet is a flexible fabric material.

9. A utility pad for infants and young children as defined in claim 1 and further characterized as including:

further fastener elements carried on the lower surface of each of said lateral sides; and lateral fastener elements on said sheet and positioned thereon to engage said further fastener elements when said sheet is fitted across said rectangular tube to close the rectangular interior space defined therewithin.

10. A utility pad for infants and young children as defined in claim 1 wherein said fastener elements are hook and loop fastener tabs.

11. A utility pad for infants and young children comprising:

a flexible, endless tube encircling and defining therewithin an enclosed interior play and sleeping space;

a cushioning material in the hollow interior of said tube;

fastener elements carried o the outer surface of said tube at spaced intervals therearound;

complimentary fastener elements;

a fabric panel having said complimentary fastener elements secured thereto at spaced locations thereon, with said complimentary fastener elements quick detachably engaging the fastener elements on the outer surface of said tube, and said fabric panel extending across said endless tube to close said interior play and sleeping space and to form a bottom floor when said tube is rested on a substantially horizontally extending supporting surface; and a pair of carrier straps located at opposite sides of said tube from each other and engageable with each other to form a carrying handle when said tube is doubled upon itself.

12. A utility pad for infants and young children as defined in claim 11 wherein said first-mentioned fastener elements are located on said tube so that some of said fastener elements in said first-mentioned group engage others of said fastener elements in said first-mentioned group when said tube is doubled upon itself to retain said tube in its doubled upon itself configuration, and to thereby form a partially encircled space within said doubled tube, which space is open along one side thereof.

13. A utility pad for infants and young children comprising:

a flexible, rectangular hollow tube defining a rectangular interior space, said tube having an encircling, substantially circular, cross-sectional configuration, and said tube having opposed, substantially parallel end portions and having spaced, parallel lateral sides, and said tube having an upper surface and a lower surface;

a flexible resilient material filling the hollow interior of the rectangular tube;

fastener elements carried on the lower surface of said tube, and arrayed to provide fastener elements on the lower surface of said end portions so that when said tube is doubled into a U-shaped configuration with one of said end portions superimposed upon, and aligned with, the other of said end portions, at least a portion of said fastener elements on each of the lower surfaces of said end portions engage each other and retain said tube in a folded, U-shaped configuration;

a pair of flexible fastener and carrier straps extending outwardly from the mid-portion of said parallel, spaced, opposite lateral sides and adapted for interengagement with each other when said rectangular tube has been doubled upon itself and then placed into a triangular configuration.

* * * * *